US006802597B2

(12) United States Patent
Furuhata

(10) Patent No.: US 6,802,597 B2
(45) Date of Patent: Oct. 12, 2004

(54) LIQUID-JET HEAD AND LIQUID-JET APPARATUS

(75) Inventor: Yutaka Furuhata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/238,892

(22) Filed: Sep. 11, 2002

(65) Prior Publication Data

US 2003/0085961 A1 May 8, 2003

(30) Foreign Application Priority Data

Sep. 13, 2001 (JP) ..... 2001-278110
Aug. 30, 2002 (JP) ..... 2002-252458

(51) Int. Cl.[7] ..... B41J 2/045
(52) U.S. Cl. ..... 347/71
(58) Field of Search ..... 347/68, 70, 71, 347/72

(56) References Cited

FOREIGN PATENT DOCUMENTS

| | | |
|---|---|---|
| EP | 0 985 535 A2 * | 3/2000 |
| JP | 10-100401 | 4/1998 |
| JP | 11-179903 | 7/1999 |
| WO | WO 98/47710 | 10/1998 |

* cited by examiner

*Primary Examiner*—Judy Nguyen
(74) *Attorney, Agent, or Firm*—Sughrue Mion, PLLC

(57) ABSTRACT

A liquid-jet head in which a wiring structure is simplified to achieve miniaturization and a liquid-jet apparatus are disclosed. The liquid-jet head includes: a sealing plate joined to a piezoelectric element side of a passage-forming substrate and having a piezoelectric element holding portion, the sealing plate hermetically sealing a space secured in a region facing a piezoelectric element to an area extent not to hinder a movement thereof; and a lead electrode provided on the passage-forming substrate and drawn out from an electrode of the piezoelectric element to an outside of the piezoelectric element holding portion, wherein the sealing plate has a plurality of penetrated holes penetrating therethrough in a thickness direction thereof, and on an inner surface of each penetrated hole, a wiring electrode is provided, one end thereof being connected to the lead electrode outside of the piezoelectric element holding portion, and other end thereof being connected to a drive wiring extended from a drive circuit for driving the piezoelectric element on an opening edge portion of the penetrated hole on a side opposite the passage-forming substrate. Thus, the wiring structure can be simplified, and the miniaturization of the head can be achieved.

10 Claims, 5 Drawing Sheets

LIQUID-JET HEAD AND LIQUID-JET APPARATUS

BACKGROUND OF THE INVENTION

1. Field of the Invention

The present invention relates to a liquid-jet head which pressurizes a liquid supplied to pressure generating chambers communicating with nozzle orifices by piezoelectric elements to jet liquid droplets from the nozzle orifices, and relates to a liquid-jet apparatus. More particularly, the present invention relates to an ink-jet recording head which ejects ink droplets from nozzle orifices, and relates to an ink-jet recording apparatus.

2. Description of the Prior Art

In an ink-jet recording head, in which pressure generating chambers that communicate with nozzle orifices ejecting ink droplets are partially constituted of vibration plates, these vibration plates are deformed by piezoelectric elements to pressurize ink in the pressure generating chambers, and the ink droplets are ejected from the nozzle orifices, two types of recording heads are put into practical use. One is a recording head using piezoelectric actuators of a longitudinal vibration mode, which expand and contract in an axis direction of the piezoelectric elements, and the other is a recording head using piezoelectric actuators of a flexural vibration mode.

In the former type, the volume of each pressure generating chamber can be changed by abutting an end surface of the piezoelectric element against the vibration plate, and manufacturing of a head suitable to high density printing is enabled. On the contrary, there are required a difficult process of cutting and dividing the piezoelectric element in a comb tooth shape in accordance with an array pitch of the nozzle orifices and work of positioning and fixing the cut and divided piezoelectric elements to the pressure generating chambers. Thus, there is a problem of a complex manufacturing process.

On the other hand, in the latter type, the piezoelectric elements can be fabricated and installed on the vibration plate by a relatively simple process of adhering a green sheet as a piezoelectric material while fitting a shape thereof to that of the pressure generating chambers and sintering the green sheet. However, a certain area of the vibration plate is required due to use of the flexural vibration, thus there is a problem that a high density array of the piezoelectric elements is difficult.

Meanwhile, in order to solve such a disadvantage of the latter recording head, as disclosed in Japanese Patent Laid-Open No. Hei 5 (1993)-286131, a recording head is proposed, in which an even piezoelectric material layer is formed over the entire surface of a vibration plate by a deposition technology, the piezoelectric material layer is cut and divided into a shape corresponding to that of pressure generating chambers by a lithography method, and piezoelectric elements are formed so as to be independent of each other for each pressure generating chamber.

The recording head described above has the following advantage. The work of adhering the piezoelectric elements to the vibration plate is eliminated, and the piezoelectric elements can be fabricated and installed by the precise and simple method that is the lithography method. In addition, a thickness of each piezoelectric actuator can be thinned to enable a high-speed drive.

SUMMARY OF THE INVENTION

In the ink-jet recording head described above, a semiconductor integrated circuit (IC) or the like for driving the piezoelectric elements is required, and this IC is mounted in the vicinity of the ink-jet recording head. Specifically, heretofore, a method has been adopted, in which the IC is disposed in the vicinities of the piezoelectric elements, and the piezoelectric elements and the IC are wired by wire bonding or the like.

However, particularly, as recording density has been increased, it has been a subject in miniaturization of the recording head that a mounting space for the IC or the like and a space for wiring the piezoelectric elements and the IC or the like should be secured.

Note that, naturally, a similar soultion to the above-described one exists not only for the a method of manufacturing the ink-jet recording head ejecting ink droplets but also in a method for manufacturing another liquid-jet head ejecting a liquid other than ink.

In consideration of circumstances as described above, the object of the present invention is to provide a liquid-jet head in which a wiring structure is simplified to achieve miniaturization and a liquid-jet apparatus.

A first aspect of the present invention that attains the foregoing object is a liquid-jet head including a passage-forming substrate in which a pressure generating chamber communicating with a nozzle orifice is defined and a piezoelectric element composed of a lower electrode, a piezoelectric layer and an upper electrode on one surface of the passage-forming substrate with a vibration plate interposed therebetween, the liquid-jet head comprising: a sealing plate joined to a piezoelectric element side of the passage-forming substrate and having a piezoelectric element holding portion, the sealing plate hermetically sealing a space secured in a region facing the piezoelectric element to an extent not to hinder a movement thereof; and a lead electrode provided on the passage-forming substrate and drawn out from any of the electrodes of the piezoelectric element to an area outside of the piezoelectric element holding portion, wherein the sealing plate has a plurality of penetrated holes penetrating therethrough in a thickness direction thereof, and on an inner surface of each penetrated hole, a wiring electrode is provided, one end thereof being connected to the lead electrode outside of the piezoelectric element holding portion, and other end thereof being connected to a drive wiring extended from a drive circuit for driving the piezoelectric element on an opening edge portion of the penetrated hole on a side opposite the passage-forming substrate.

In the first aspect, each lead electrode drawn out from the electrode of the piezoelectric element is extended to a surface of the sealing plate on the side opposite the passage-forming substrate by the wiring electrode formed in the relatively micro penetrated hole. Therefore, the lead electrode and the drive wiring can be connected in a relatively small space, and the miniaturization of the head can be achieved.

A second aspect of the present invention is the liquid-jet head according to the first aspect, characterized in that the wiring electrode is continuously provided to an opening edge portion on a passage-forming substrate side of the penetrated hole.

In the second aspect, the lead electrode and the wiring electrode are connected easily and securely.

A third aspect of the present invention is the liquid-jet head according to any one of the first and second aspects, characterized in that the wiring electrode is filled in the penetrated hole.

In the third aspect, the region corresponding to the opening of the penetrated hole of the sealing plate is plugged with the wiring electrode. Therefore, the wiring electrode and the drive wiring can be connected on the region facing to the penetrated, and the head can be further miniaturized.

A fourth aspect of the present invention is the liquid-jet head according to any one of the first to third aspects, characterized in that the wiring electrode is formed of a thin film.

In the fourth aspect, even in the relatively small space, the wiring electrode can be formed easily and securely.

A fifth aspect of the present invention is the liquid-jet head according to the fourth aspect, characterized in that the wiring electrode is formed by any of plating and sputtering.

In the fifth aspect, the wiring electrode composed of the thin film can be formed relatively easily.

A sixth aspect of the present invention is the liquid-jet head according to any one of the first to fifth aspects, characterized in that the drive wiring is composed of a bonding wire.

In the sixth aspect, the wiring electrode and the drive circuit can be connected easily, and the manufacturing efficiency is enhanced.

A seventh aspect of the present invention is the liquid-jet head according to any one of the first to sixth aspects, characterized in that the sealing plate is composed of a single crystal silicon substrate.

In the seventh aspect, the penetrated hole can be formed with relatively high precision in high density.

An eighth aspect of the present invention is the liquid-jet head according to any one of the first to seventh aspects, characterized in that the sealing plate also serves as a reservoir forming plate having a reservoir portion at least partially constituting a reservoir made to communicate with the pressure generating chamber.

In the eighth aspect, a reservoir having a relatively large volume can be formed, and the simplification of the structure can be achieved.

A ninth aspect of the present invention is the liquid-jet head according to any one of the first to eighth aspects, characterized in that the pressure generating chamber is formed by carrying out anisotropic etching to the single crystal silicon substrate, and each layer of the piezoelectric element is formed of a thin film by a lithography method.

In the ninth aspect, the liquid-jet head having the nozzle orifices in high density can be manufactured relatively easily in a large quantity.

A tenth aspect of the present invention is a liquid-jet apparatus comprising the liquid-jet head according to any one of the first to ninth aspects.

In the tenth aspect; the miniaturization of the liquid-jet apparatus can be achieved.

DESCRIPTION OF THE PREFERRED EMBODIMENTS

The present invention will be described below in detail based on an embodiment.

Embodiment 1

Figure 1:
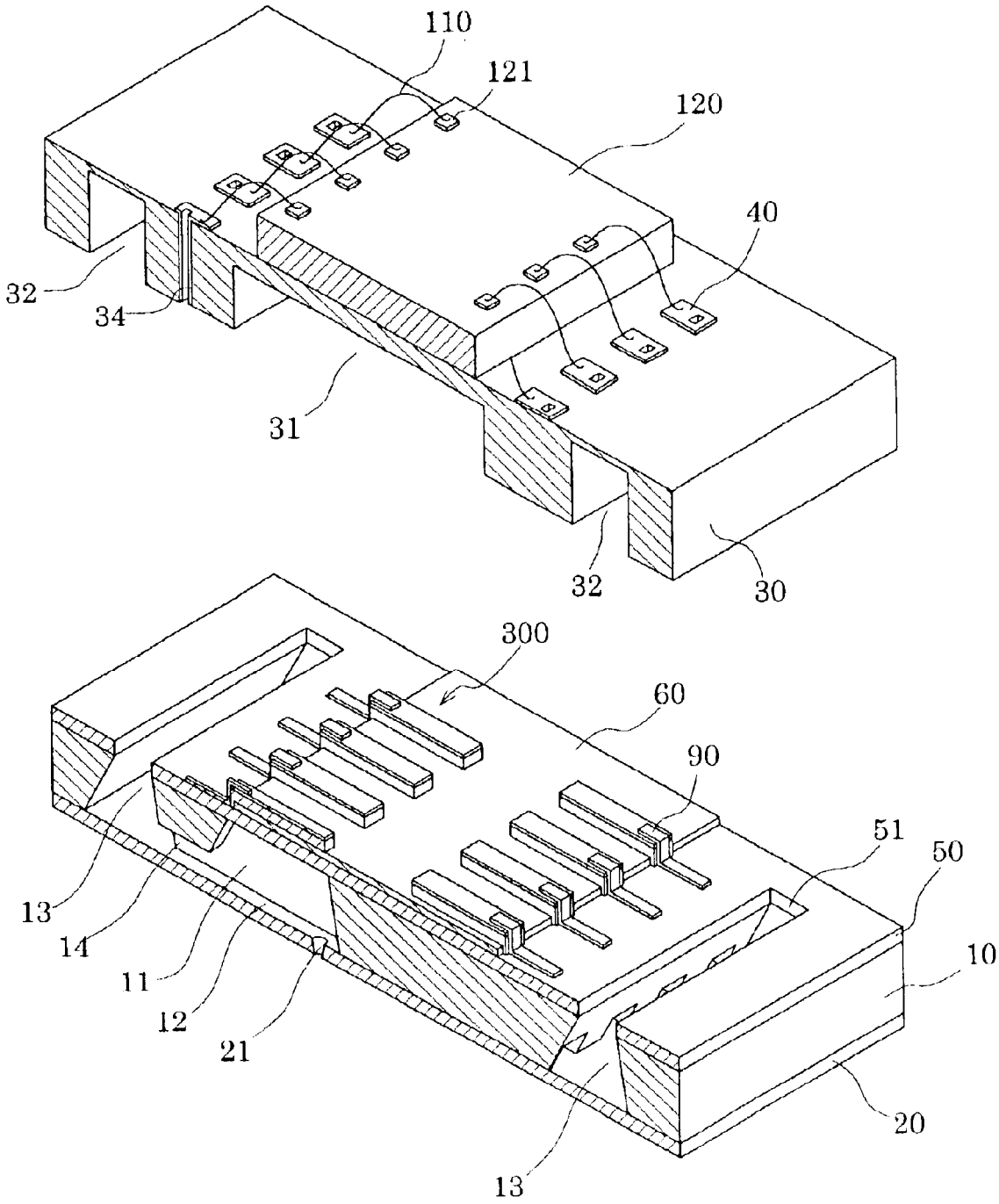
FIG. 1 is a perspective view of an ink-jet recording head according to Embodiment 1 of the present invention.
Figure 2A:
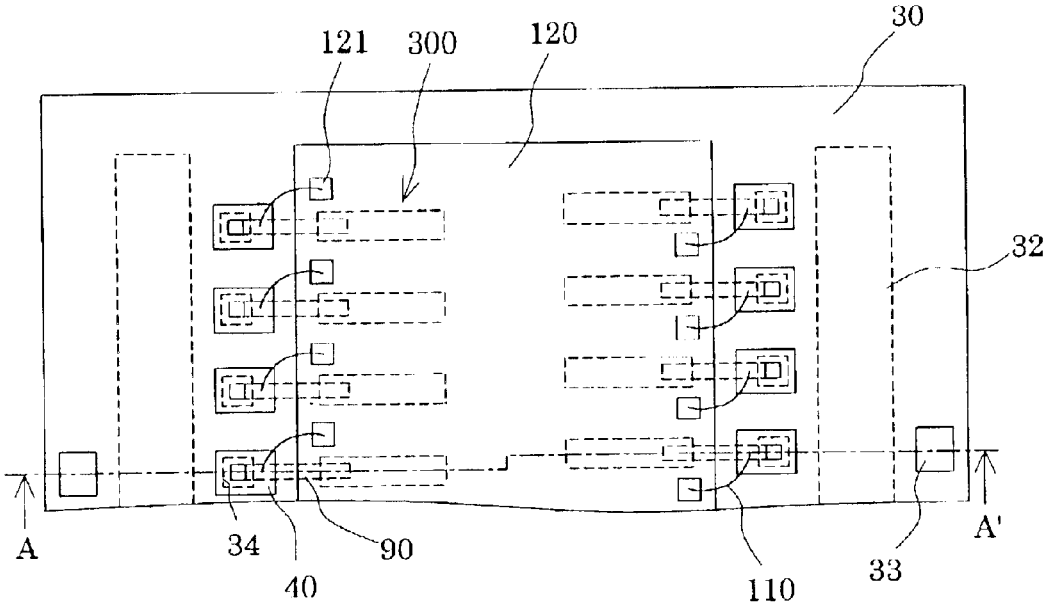
FIGS. 2A and 2B are a plan view and a cross-sectional view of the ink-jet recording head according to Embodiment 1 of the present invention, respectively.
Figure 2B:
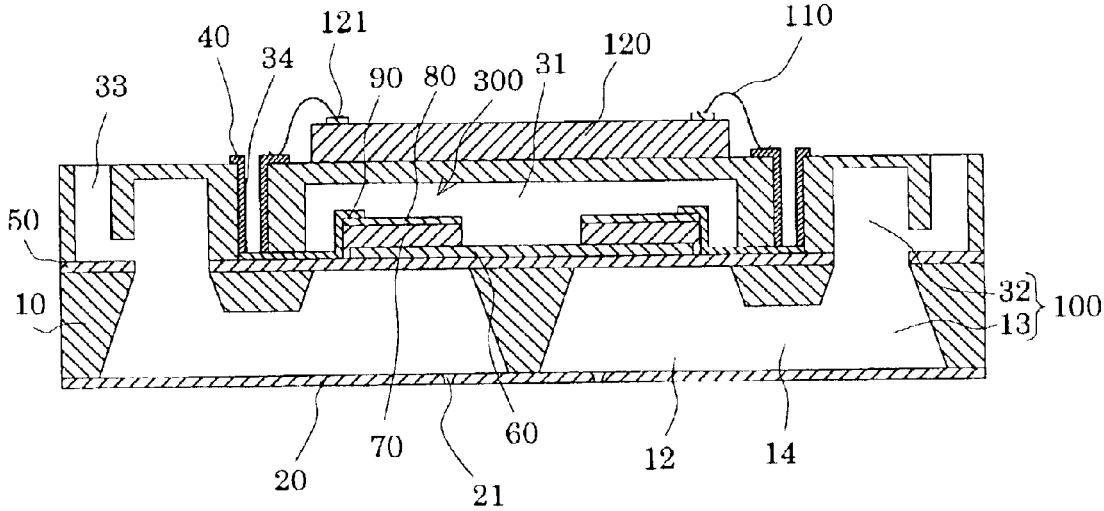

FIG. 1 is a perspective view showing an ink-jet recording head according to Embodiment 1 of the present invention, and FIGS. 2A and 2B are a plan view and a cross-sectional view of FIG. 1, respectively.

As illustrated, a passage-forming substrate 10 is composed of a single crystal silicon substrate of a plane orientation (110) in this embodiment. As the passage-forming substrate 10, usually, one having a thickness of about 150 to 300 μm is used, and one desirably having a thickness of about 180 to 280 μm and more desirably having a thickness of about 220 μm is suitable. This is because an array density of the pressure generating chambers can be enhanced while keeping a rigidity of compartment walls between adjacent pressure generating chambers.

One surface of the passage-forming substrate 10 becomes an opening surface, and on the other surface, an elastic film 50 is formed, which is made of silicon dioxide formed in advance by thermal oxidation and has a thickness of 1 to 2 μm.

Meanwhile, on the opening surface of the passage-forming substrate 10, pressure generating chambers 12 partitioned by a plurality of compartment walls 11 are provided in parallel in the width direction by carrying out anisotropic etching to the single crystal silicon substrate. In a area outside of, and in a longitudinal direction from the pressure generating chambers 12, there are formed communicating paths 13, each communicating with a reservoir portion of a sealing plate to be described later and constituting a part of a reservoir 100 which will be a common ink chamber to the respective pressure generating chambers 12. Each communicating path 13 is made to communicate via ink supply paths 14 with one ends in the longitudinal direction of the respective pressure generating chambers 12.

Here, the anisotropic etching is carried out by utilizing a difference in etching rates of the single crystal silicon substrate. For example, in this embodiment, the anisotropic etching is carried out by utilizing the following property of the single crystal silicon substrate. Specifically, when the single crystal silicon substrate is immersed in an alkali solution such as KOH, it is gradually eroded, there emerge a first (111) plane perpendicular to the (110) plane and a second (111) plane forming an angle of about 70 degrees to the first (111) plane and an angle of about 35 degrees to the above-described (110) plane. As compared with an etching rate of the (110) plane, an etching rate of the (111) plane is about 1/180. With such anisotropic etching, it is possible to perform high-precision processing based on depth processing in a parallelogram shape formed of two of the first (111) planes and two of the second (111) planes slant thereto, and thus the pressure generating chambers 12 can be arranged in a high density.

In this embodiment, long sides of the respective pressure generating chambers 12 are formed of the first (111) planes, and short sides thereof are formed of the second (111) planes. These pressure generating chambers 12 are formed by etching the passage-forming substrate 10 until the etching almost penetrates through the passage-forming substrate 10 to reach the elastic film 50. Here, the elastic film 50 is only slightly eroded by the alkali solution used for etching the single crystal silicon substrate. Moreover, the respective ink supply paths 14 communicating with the one ends of the pressure generating chambers 12 are formed to be shallower than the pressure generating chambers 12, and thus passage resistance of ink flowing into the pressure generating chambers 12 is maintained constant. Specifically, the ink supply paths 14 are formed by etching the single crystal silicon substrate partway in the thickness direction (half-etching). Note that the half-etching is carried out by adjusting the etching time.

On the opening surface side of the passage-forming substrate 10, a nozzle plate 20 having nozzle orifices 21 drilled therein is fixedly adhered via an adhesive or a thermowelding film, each nozzle orifice 21 communicating with the pressure generating chamber 12 at a spot opposite to the ink supply passage 14. Note that the nozzle plate 20 is made of glassceramics, stainless steel or the like, which has a thickness of, for example, 0.1 to 1 mm and a linear expansion coefficient of, for example, 2.5 to 4.5 [$\times 10^{-6}$/°C.] at a temperature of 300° C. or lower. With one surface, the nozzle plate 20 wholly covers one surface of the passage-forming substrate 10 and also plays a role of a reinforcement plate for protecting the single crystal silicon substrate from an impact or an external force. Moreover, the nozzle plate 20 may be formed of a material having a thermal expansion coefficient approximately equal to that of the passage-forming substrate 10. In this case, since deformations of the passage-forming substrate 10 and the nozzle plate 20 due to heat become approximately the same, the passage-forming substrate 10 and the nozzle plate 20 can be joined easily to each other by use of a thermosetting adhesive and the like.

Here, the size of the pressure generating chambers 12 applying an ink droplet ejection pressure to ink and the size of the nozzle orifices 21 ejecting ink droplets are optimized in accordance with the amount of ejected ink droplets, the ejection speed thereof and the ejection frequency thereof For example, in a case where 360 ink droplets per one inch are recorded, it is necessary to form the nozzle orifices 21 in a diameter of several ten micrometers with good precision.

Meanwhile, on the elastic film 50 facing the opening surface of the passage-forming substrate 10, a lower electrode film 60 having a thickness of, for example, about 0.2 $\mu$m, a piezoelectric layer 70 having a thickness of, for example, about 1 $\mu$m, and an upper electrode film 80 having a thickness of, for example, about 0.1 $\mu$m are formed in a stacked state in a process to be described later, thus constituting a piezoelectric element 300. Here, the piezoelectric element 300 means a portion including the lower electrode film 60, the piezoelectric layer 70 and the upper electrode film 80. In general, the piezoelectric element 300 is constituted such that any one of electrodes thereof is made to be a common electrode, and that the other electrode and the piezoelectric layer 70 are patterned for each pressure generating chamber 12. Here, a portion, which is constituted of the patterned one of electrodes and the patterned piezoelectric layer 70, and where a piezoelectric distortion is generated by application of a voltage to both of the electrodes, is referred to as a piezoelectric active portion. In this embodiment, the lower electrode film 60 is made to be a common electrode of the piezoelectric element 300, and the upper electrode film 80 is made to be an individual electrode of the piezoelectric element 300. However, no impediment occurs even if the above-described order is reversed for the convenience of a drive circuit or a wiring. In any case, a piezoelectric active portion will be formed for each pressure generating chamber. In addition, a combination of the piezoelectric element 300 and a vibration plate in which displacement occurs due to the drive of the piezoelectric element 300 is referred to as a piezoelectric actuator.

Furthermore, in this embodiment, each piezoelectric element 300 is patterned in a region facing each pressure generating chamber 12, and a lead electrode 90 is extended from the upper electrode film 80 of each piezoelectric element 300 onto the elastic film 50 in the outside of a piezoelectric element holding portion 31 of the sealing plate 30 to be described later. Furthermore, as described in detail later, this lead electrode 90 is connected to a drive circuit 120 via a wiring electrode 40 and a drive wiring 110.

On the piezoelectric element 300 side of the passage-forming substrate 10, the sealing plate 30 having the piezoelectric element, holding portion 31 is joined, which is capable of hermetically a space secured to an extent not to hinder a movement of the piezoelectric elements 300. The piezoelectric elements 300 are hermetically sealed in the piezoelectric element holding portion 31. Note that, in this embodiment, the piezoelectric element holding portion 31 is formed in a size covering the plurality of piezoelectric elements 300 provided in parallel in the width direction.

The piezoelectric elements 300 are shielded from an external environment by the piezoelectric element holding portion 31 of the sealing plate 30 in such a manner, and thus destruction of the piezoelectric elements 300, which is caused by the external environment such as by moisture, can be prevented. Moreover, although the inside of the piezoelectric element holding portion 31 is only shielded hermetically in this embodiment, for example, the space in the piezoelectric element holding portion 31 is evacuated or set in an atmosphere of nitrogen or argon, and thus the inside of the piezoelectric element holding portion 31 can be maintained at a low humidity, and the destruction of the piezoelectric elements 300 can be prevented far more securely.

Moreover, the sealing plate 30 also serves as a reservoir forming plate, and on a region facing each communicating path 13, a reservoir portion 32 constituting at least a part of the reservoir 100 is provided. In this embodiment, this reservoir portion 32 is formed so as to penetrate through the sealing plate 30 in the thickness direction and to be across to the width direction of the pressure generating chambers 12. As described above, the reservoir portion 32 is made to communicate with the communicating path 13 of the passage-forming substrate 10 via a communicating hole 51 to constitute the reservoir 100 which will be the common ink chamber to the respective pressure generating chambers 12.

Note that, in an area outside of the approximately center portion in the longitudinal direction of the reservoir 100 of the sealing plate 30, an ink introducing path for supplying ink to the reservoir 100 is formed.

For the sealing plate 30 as described above, it is preferable to use a material having approximately the same thermal expansion coefficient as that of the passage-forming substrate 10, for example, a glass material, a ceramics material or the like. In this embodiment, the sealing plate 30 is formed of a single crystal silicon substrate which is the same material as the passage-forming substrate 10. Thus, similarly to the case of the above-described nozzle plate 20, both of the sealing plate 30 and the passage-forming substrate 10 can be securely adhered even if the adhesion is carried out at a high temperature by use of a thermosetting adhesive. Hence, the manufacturing process thereof can be simplified.

Moreover, on this sealing plate 30, the drive circuit 120 such as a semiconductor integrated circuit (IC) including, for example, a circuit board or a drive circuit for driving the piezoelectric elements 300 is mounted. The drive circuit 120 is electrically connected to the lead electrodes 90 extended from the piezoelectric elements 300 via the wiring electrodes 40 and the drive wirings 110.

Concretely, in each region between the piezoelectric element holding portion 31 and the reservoir portion 32 of the sealing plate 30, which corresponds to the vicinity of the end portion of each lead electrode 90, a micro penetrated hole 34 penetrating through the sealing plate 30 in the thickness direction is formed.

Moreover, on the inner surface of this penetrated hole 34 and on the surface of the drive circuit 120 side of the sealing plate 30, the wiring electrode 40 made of, for example, a conductive thin film of gold (Au) or the like is continuously provided. This wiring electrode 40 is formed before joining the sealing plate 30 and the passage-forming substrate 10, and by joining the sealing plate 30 and the passage-forming substrate 10, the wiring electrode 40 and the lead electrode 90 are electrically connected.

A method of forming the penetrated hole 34 as described above is not particularly limited, and any method may be employed. However, the penetrated hole 34 can be formed in a relatively high density with relatively high precision by, for example, laser processing, dry etching or the like. For example, in this embodiment, the penetrated hole 34 having an approximately rectangular opening shape with each side of about several ten micrometers is formed by dry etching. As a matter of course, the opening shape of the through hole 34 may be other shapes, for example, such as a circle.

Moreover, a method of forming the wiring electrode 40 is not particularly limited, either. However, for example, a conductive layer which will be the wiring electrode is formed over the entire surface of the sealing plate 30 by plating, sputtering or the like, then the conductive layer is patterned, and thus the wiring electrode 40 can be formed relatively easily. In addition, a material of the wiring electrode 40 is not particularly limited, and any material can be used as long as it has conductivity.

Furthermore, the wiring electrode 40 as described above and a wiring portion 121 of the drive circuit 120 provided on the sealing plate 30 are electrically connected by the drive wiring 110 composed of a bonding wire or the like, and thus the drive circuit 120 and the lead electrode 90 extended from each piezoelectric element 300 will be electrically connected via these wiring electrodes 40 and drive wiring 110.

In the constitution of this embodiment as described above, the wiring electrode 40 composed of the thin film is provided in the micro penetrated hole 34 provided in the region of the sealing plate 30, which faces each lead electrode 90. Therefore, the lead electrode 90 extended from each piezoelectric element 300 will be extended from the passage-forming substrate 10 side of the sealing plate 30 to the surface opposite therewith by this wiring electrode 40. Thus, the wiring structure can be simplified more than a direct connection of the drive circuit 120 and the lead electrode 90 by the drive wiring 110, and the area required for the connection is reduced. Hence, an interval between the piezoelectric element holding portion 31 and the reservoir portion 32 can be narrowed, and the miniaturization of the head can be achieved.

Moreover, in this embodiment, the wiring electrode 40 is formed before joining the passage-forming substrate 10 and the sealing plate 30. Therefore, the wiring electrode 40 can be formed easily and efficiently. Hence, the miniaturization of the head can be achieved, and the manufacturing efficiency can be enhanced to reduce manufacturing costs.

Figure 3:
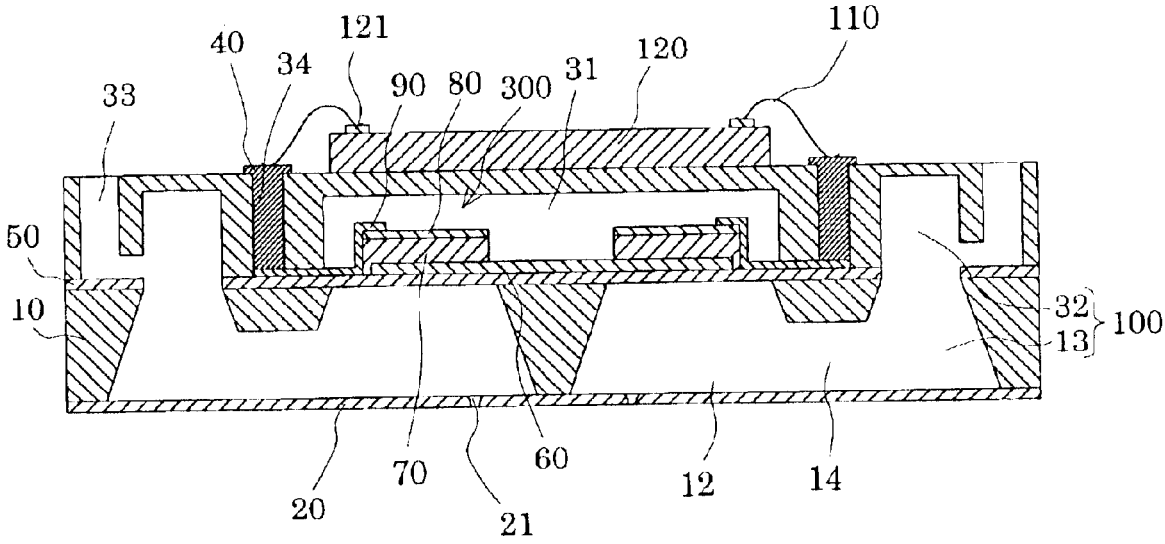
FIG. 3 is a cross-sectional view showing a modification example of the ink-jet recording head according to Embodiment 1 of the present invention.

Note that, although the wiring electrode 40 composed of the thin film is formed with a predetermined thickness on the inner surface of the penetrated hole 34 in this embodiment, for example, as shown in FIG. 3, the wiring electrode 40 may be filled in the penetrated hole 34. Thus, an opening portion of the wiring electrode 40 becomes approximately flat and can be effectively utilized as a connecting portion to the drive wiring 110, and thus the head can be further miniaturized.

Figure 4:
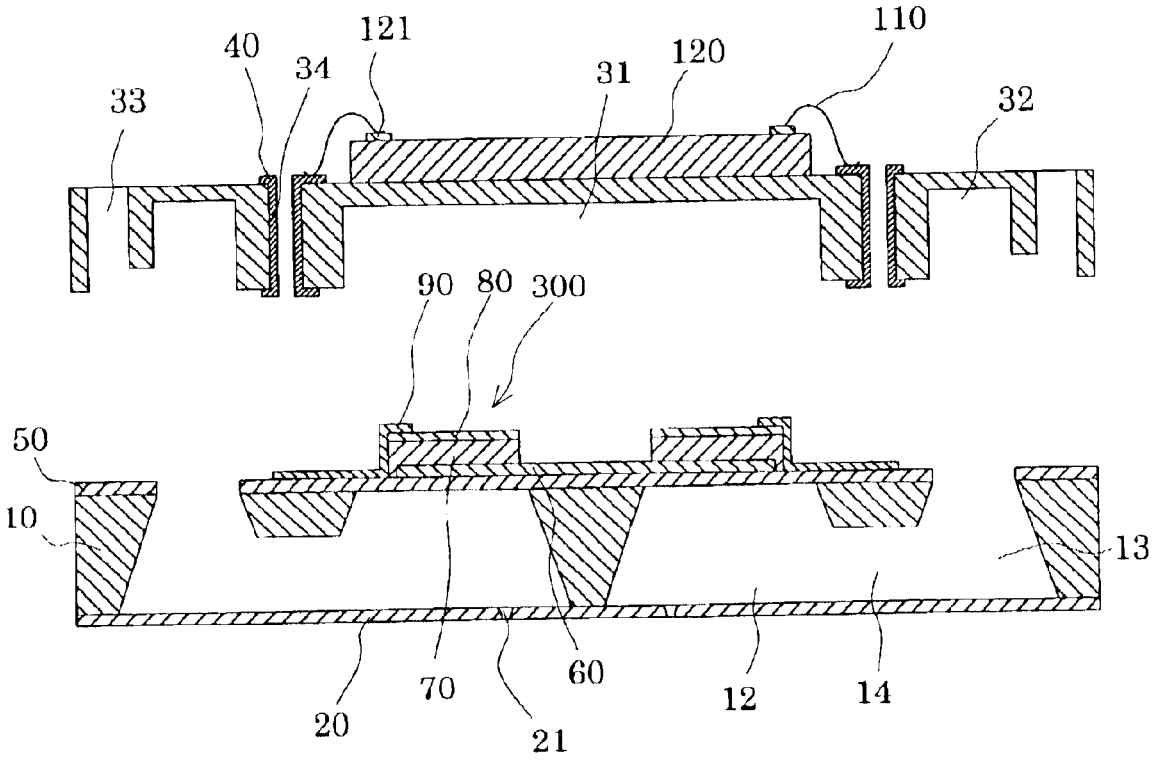
FIG. 4 is a cross-sectional view showing another modification example of the ink-jet recording head according to Embodiment 1 of the present invention.

Moreover, though the wiring electrode 40 is continuously provided only on the inner surface of the penetrated hole 34 of the sealing plate 30 and on the opening edge portion on the drive circuit 120 side in this embodiment, for example, as shown in FIG. 4, the wiring electrode 40 may be continuously provided also on the joining surface of the sealing plate 30 to the passage-forming substrate 10. Thus, in the case of joining the sealing plate 30 and the passage-forming substrate 10, the wiring electrode 40 and the lead electrode 90 can be electrically connected easily and securely.

The ink-jet recording head of this embodiment as described above takes in ink from the ink introducing path 33 connected to unillustrated external ink supplying means, and fills the ink in the inside thereof from the reservoir 100 to the nozzle orifices 21. Then, in accordance with a recording signal from an unillustrated external drive circuit, the ink-jet recording head applies a voltage between the lower electrode film 60 and the upper electrode film 80, which correspond to each pressure generating chamber 12, and the elastic film 50, the lower electrode film 60 and the piezoelectric layer 70 are subjected to flexural deformation. Thus, the pressure in each pressure generating chamber 12 is increased, and ink droplets are ejected from each nozzle orifice 21.

Other Embodiment

Although the embodiment of the present invention has been described as above, the basic constitution of the ink-jet recording head is not limited to the above-described.

For example, in the above-described embodiment, each lead electrode 90 is extended from the upper electrode film 80 as the individual electrode of the piezoelectric element 300 to the outside of the pressure generating chamber 12, that is, to the outside of the piezoelectric element holding portion 31, and then connected to the wiring electrode 40. However, not being limited to this, for example, each piezoelectric element 300 may be extended to the outside of the piezoelectric element holding portion 31, and the upper electrode film 80 as the individual electrode of the piezoelectric element 300 and the wiring electrode 40 may be directly connected. Note that, even if such a constitution is adopted, the piezoelectric active portion as the substantial drive portion of the piezoelectric element 300 is hermetically sealed in the piezoelectric element holding portion 31, and therefore, the destruction of the piezoelectric element 300 can be prevented.

Moreover, for example, though description has been made for the example where each lead electrode 90 is extended from the upper electrode film 80 as the individual electrode of the piezoelectric element 300 to the outside of the piezoelectric element holding portion 31 in the above-described embodiment, the present invention is not limited to this. For example, each lead electrode may be extended from the lower electrode film as the common electrode to the piezoelectric elements to the outside of the piezoelectric element holding portion, and similarly to the case of the upper electrode film, each lead electrode and the drive circuit may be substantially connected by the wiring electrode and the drive wiring.

Moreover, for example, the nozzle plate 20 having the nozzle orifices 21 is joined to the passage-forming substrate 10 in the above-described embodiment. However, not being limited to this, for example, a multilayer structure may be adopted, which includes another substrate that has nozzle communicating holes and the like provided so that the nozzle orifices and the pressure generating chambers can communicate with each other.

Furthermore, for example, the drive circuit is mounted on the sealing plate joined to the passage-forming substrate 10 in the above-described embodiment. However, not being limited to this, for example, the drive circuit may be formed directly on this sealing plate. Thus, a necessity of mounting the drive circuit separately is eliminated, and the manufacturing costs can be further reduced. Moreover, as a matter of course, the drive circuit may be mounted on a member other than the sealing plate.

Note that, in the above-described embodiment, the thin-film-type ink-jet recording head manufactured by applying the deposition and the lithography process is taken as an example. However, naturally, the present invention is not limited to this. For example, the present invention can also be employed for a thick-film-type ink-jet recording head formed by a method of adhering a green sheet or the like.

Figure 5:
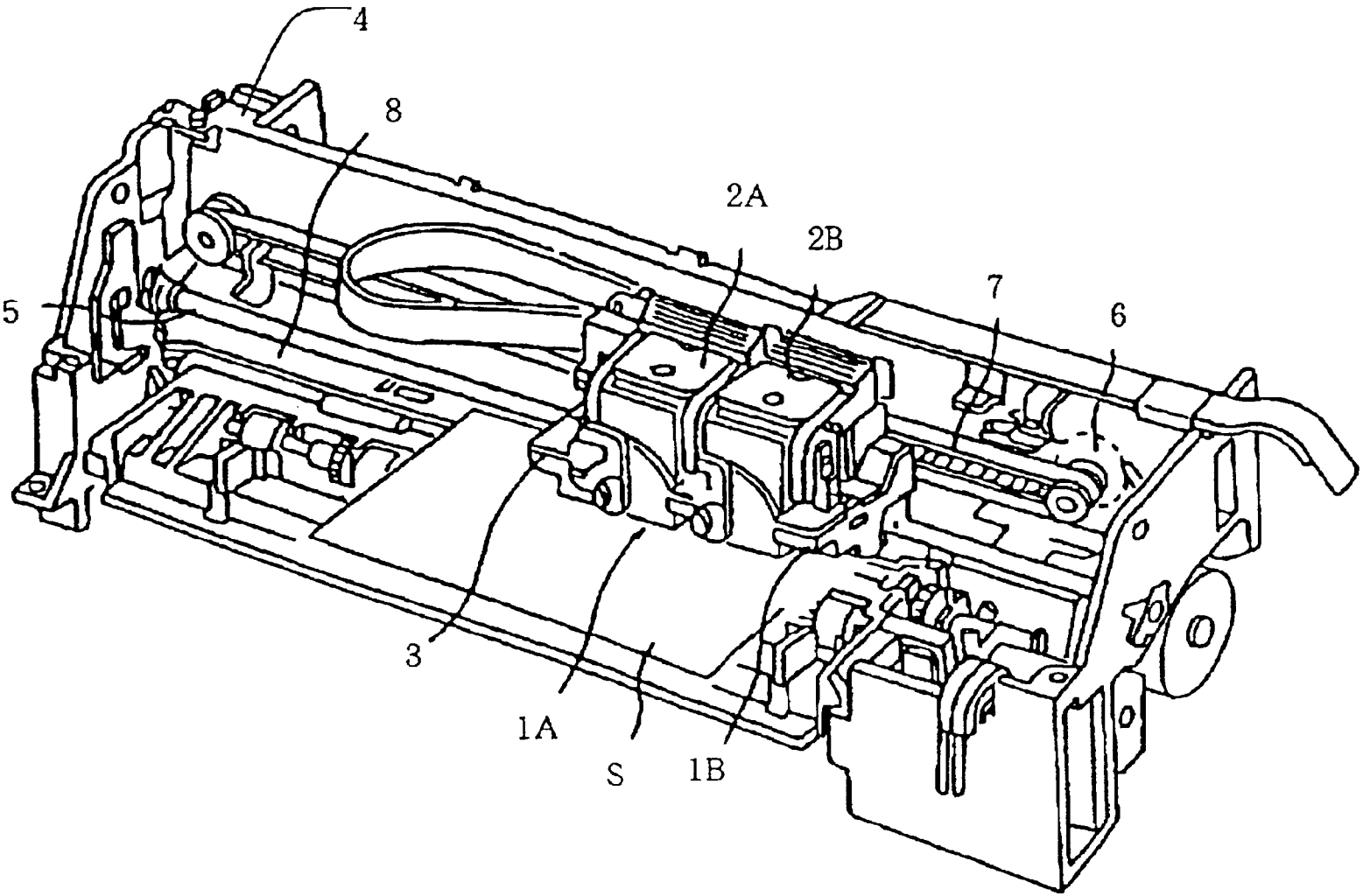
FIG. 5 is a schematic view of an ink-jet recording apparatus according to one embodiment of the present invention.

Moreover, the ink-jet recording head of the embodiment partially constitutes a recording head unit provided with an ink passage communicating with an ink cartridge or the like, and is mounted on an ink-jet recording apparatus. FIG. 5 is a schematic view showing an example of the ink-jet recording apparatus.

As shown in FIG. 5, in recording head units 1A and 1B having the ink-jet recording heads, cartridges 2A and 2B constituting ink supplying means are detachably provided. A carriage 3 having these recording head units 1A and 1B mounted thereon is provided on a carriage shaft 5 attached onto an apparatus body 4 so as to be freely movable in the shaft direction. These recording head units 1A and 1B, for example, are set to eject a black ink composition and a color ink composition, respectively.

Furthermore, a driving force of a drive motor 6 is transmitted to the carriage 3 via a plurality of unillustrated gears and a timing belt 7, and thus the carriage 3 having the recording head units 1A and 1B mounted thereon is moved along the carriage shaft 5. Meanwhile, a platen 8 is provided onto the apparatus body 4 along the carriage shaft 5. A recording sheet S as a recording medium such as paper fed by an unillustrated paper feed roller or the like is conveyed on the platen 8.

Note that, though the ink-jet recording head ejecting ink has been exemplified as a liquid-jet head in the above description, the present invention is aimed to broadly cover the overall liquid-jet head and liquid-jet apparatus.

As such a liquid-jet head, for example, a recording head for use in an image recording apparatus such as a printer, a color-material-jet head for use in manufacturing a color filter of a liquid crystal display or the like, an electrode-material-jet head for use in forming an electrode of an organic EL display, an FED (field emission display) or the like, a bioorganic-material-jet head for use in manufacturing a biochip, and the like can be given.

As described above, according to the present invention, the connection of the lead electrodes and the drive circuit by the wire bonding can be carried out on the sealing plate, and the area required for the connection can be restricted to be small. Hence, the interval between each reservoir and the piezoelectric element holding portion can be narrowed, and the miniaturization of the head can be achieved.

What is claimed is:

1. A liquid-jet head including a passage-forming substrate in which a pressure generating chamber communicating with a nozzle orifice is defined and a piezoelectric element composed of a lower electrode, a piezoelectric layer and an upper electrode on one surface of the passage-forming substrate via a vibration plate interposed therebetween, the liquid-jet head comprising:

a sealing plate joined to a piezoelectric element side of the passage-forming substrate and having a piezoelectric element holding portion, the sealing plate hermetically sealing a space secured in a region facing the piezoelectric element to an extent not to hinder a movement thereof; and a lead electrode provided on the passage-forming substrate and drawn out from any of the electrodes of the piezoelectric element to an area outside of the piezoelectric element holding portion, wherein the sealing plate has a plurality of micro penetrated holes penetrating therethrough in a thickness direction thereof, and on all of an inner surface of each penetrated hole, a wiring electrode is provided, one end thereof being connected to the lead electrode in the outside of the piezoelectric element holding portion, and other end thereof being connected to a drive wiring extended from a drive circuit for driving the piezoelectric element on an opening edge portion of the penetrated hole on an opposite side with the passage-forming substrate.

2. The liquid-jet head according to claim 1, wherein the wiring electrode is continuously provided to an opening edge portion on a passage-formed substrate side of the penetrated hole.

3. The liquid-jet head according to claim 1, wherein the wiring electrode is filled in the penetrated hole.

4. The liquid-jet head according to claim 1, wherein the wiring electrode is formed of a thin film.

5. The liquid-jet head according to claim 4, wherein the wiring electrode is formed by any of plating and sputtering.

6. The liquid-jet head according to claim 1, wherein the drive wiring is composed of a bonding wire.

7. The liquid-jet head according to claim 1, wherein the sealing plate is composed of a single crystal silicon substrate.

8. The liquid-jet head according to claim 1, wherein the sealing plate also serves as a reservoir forming plate having a reservoir portion at least partially constituting a reservoir made to communicate with the pressure generating chamber.

9. The liquid-jet head according to claim 1, wherein the pressure generating chamber is formed by carrying out anisotropic etching to the single crystal silicon substrate, and each layer of the piezoelectric element is formed of a thin film by a lithography method.

10. A liquid-jet apparatus comprising the liquid-jet head according to any one of claims 1 and 4 to 9.

* * * * *